United States Patent [19]

Burrell

[11] 3,938,264

[45] Feb. 17, 1976

[54] SOCK AND SHOE

[75] Inventor: Julius W. Burrell, Montebello, Calif.

[73] Assignee: The Raymond Lee Organization, Inc., New York, N.Y. ; a part interest

[22] Filed: Jan. 15, 1975

[21] Appl. No.: 541,231

[52] U.S. Cl. ..... 36/1

[51] Int. Cl.[2] ..... A43B 00/00

[58] Field of Search ..... 36/1, 1.5, 10, 43, 58.5, 36/70; 2/239, DIG. 6

[56] References Cited

UNITED STATES PATENTS

| | | | |
|---|---|---|---|
| 2,948,971 | 8/1960 | Shecter et al. | 36/1 |
| 2,965,982 | 12/1960 | Saffir | 36/1 |
| 3,099,884 | 8/1963 | Kixmiller et al. | 2/DIG. 6 |

*Primary Examiner*—Patrick D. Lawson

*Attorney, Agent, or Firm*—Howard I. Podell

[57] ABSTRACT

A sock for wearing on the feet which is restrained from creeping between the toes, when worn in the shoe of the invention. The forward external toe section of the sock is fitted with a Velcro patch of a size to engage a Velcro patch fastened inside the forward toe section of the shoe. When the sock and shoe are worn together, the Velcro sections attach to each other maintaining the toe section of the sock in the forward section of the shoe and restraining the forward section of the sock from creeping between the toes of the wearer.

3 Claims, 2 Drawing Figures

SOCK AND SHOE

SUMMARY OF THE INVENTION

My invention is a sock for wearing on the feet which is restrained from creeping between the toes, when worn in the shoe of the invention. The forward external toe section of the sock is fitted with a Velcro patch of a size to engage a Velcro patch fastened inside the forward toe section of the shoe. When the sock and shoe are worn together, the Velcro sections attach to each other maintaining the toe section of the sock in the forward section of the shoe and restraining the forward section of the sock from creeping between the toes of the wearer.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
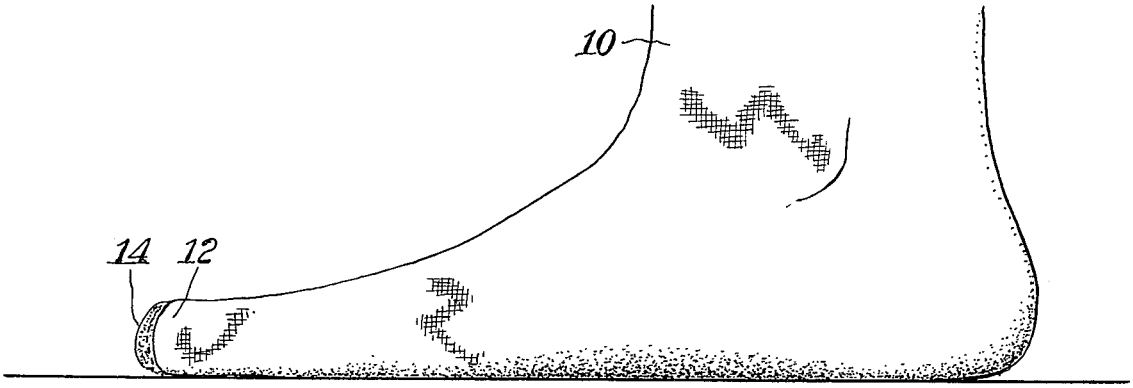
FIG. 1 is an elevation view of the sock of the invention.
Figure 2:
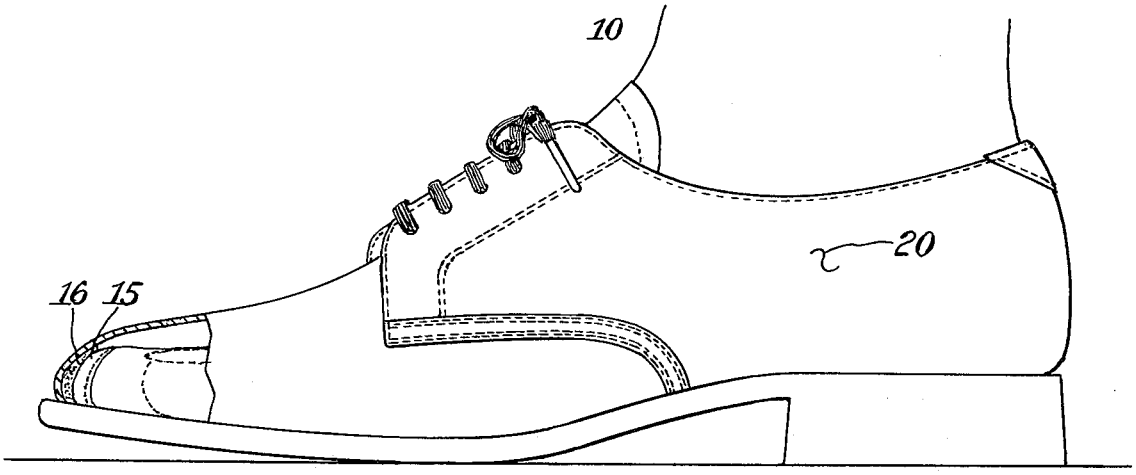
FIG. 2 is a sectional elevation view of the sock and shoe of the invention, in use.

Turning now descriptively to the drawings, in which similar reference characters denote similar elements throughout the several views, FIGS. 1–2 show the sock 10 which is made of a conventional fabric and shape for fitting over the foot of a wearer. The forward external section 12 of the sock 10 is fitted with a Velcro fabric

14 shaped to matingly engage a Velcro fabric section 16 fastened inside a shoe 20 at the forward end 25 of the shoe 20, when the sock 10 and shoe 20 are worn together, with the forward end 12 of the sock 10 restrained from creeping between the toes of the wearer.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A shoe fitted with a section of Velcro material in the inside forward toe section of the shoe for the purpose of engaging the forward section of the sock of a wearer of the shoe, said Velcro material being fixed to a forward toe section of the shoe that is inclined generally perpendicular to the plane of the sole of the said shoe.

2. The combination as recited in claim 1 together with a sock of a shape to completely enclose the portion of a foot, on which it is worn, within a shoe, said sock fitted with a section of Velcro material mounted externally of the forward toe section of the sock in a position to matingly engage the section of Velcro material located in the toe section of the shoe.

3. The combination as recited in claim 2 worn together on the foot of a user, with the forward section of the stocking engaged to the forward section of the shoe so as to retain the forward section of the stocking free of engagement between the toes of the wearer.

* * * * *